US008250775B2

(12) United States Patent
Magaldi

(10) Patent No.: US 8,250,775 B2
(45) Date of Patent: Aug. 28, 2012

(54) AUTOMATIC SYSTEM OF STORAGE, DEHUMIDIFICATION AND REUPTAKE OF PETCOKE IN A COVERED YARD

(75) Inventor: Mario Magaldi, Salerno (IT)

(73) Assignee: Magaldi Ricerche E Brevetti S.R.L., Salerno (IT)

( * ) Notice: Subject to any disclaimer, the term of this patent is extended or adjusted under 35 U.S.C. 154(b) by 346 days.

(21) Appl. No.: 12/527,533

(22) PCT Filed: Feb. 18, 2008

(86) PCT No.: PCT/IB2008/001998

§ 371 (c)(1),
(2), (4) Date: Mar. 24, 2010

(87) PCT Pub. No.: WO2008/139327

PCT Pub. Date: Nov. 20, 2008

(65) Prior Publication Data

US 2010/0180463 A1 Jul. 22, 2010

(30) Foreign Application Priority Data

Feb. 22, 2007 (IT) ..... MI2007A0343

(51) Int. Cl.
*F26B 11/12* (2006.01)

(52) U.S. Cl. ..... 34/282; 34/381; 34/138; 34/180; 48/127.5; 48/127.7; 423/63; 423/67; 122/460

(58) Field of Classification Search ..... 34/282, 34/380, 381, 497, 130, 138, 180, 90; 48/127.5, 48/127.7; 423/63, 67; 122/460
See application file for complete search history.

(56) References Cited

U.S. PATENT DOCUMENTS

| | | | | |
|---|---|---|---|---|
| 5,310,494 | A | 5/1994 | Bennett | |
| 2009/0020456 | A1 * | 1/2009 | Tsangaris et al. | 208/133 |
| 2010/0180463 | A1 * | 7/2010 | Magaldi | 34/282 |
| 2011/0036308 | A1 * | 2/2011 | Betzer-Zilevitch | 122/5.52 |
| 2011/0118518 | A1 * | 5/2011 | Nesterenko et al. | 585/329 |

FOREIGN PATENT DOCUMENTS

| | | | |
|---|---|---|---|
| DE | 3731597 | A1 * | 4/1988 |
| EP | 85757 | A1 * | 8/1983 |
| FR | 2768026 | A1 * | 3/1999 |
| GB | 2047396 | A * | 11/1980 |
| JP | 63148966 | A * | 6/1988 |
| WO | 03/057604 | | 7/2003 |
| WO | WO 2004069292 | A1 * | 8/2004 |
| WO | WO 2007033158 | A2 * | 3/2007 |

OTHER PUBLICATIONS

PCT International Search Report for PCT/IB2008/001998 filed on Feb. 18, 2008 in the name of Magaldi Ricerche E Brevetti S.R.L.
PCT Written Opinion for PCT/IB2008/001998 filed on Feb. 18, 2008 in the name of Magaldi Ricerche E Brevetti S.R.L.
Predel, Heinrich "Petroleum Coke". *Ullmann's Encyclopedia of Industrial Chemistry*, pp. 1-8, XP002236199 (Jun. 15, 2000).

* cited by examiner

*Primary Examiner* — Stephen M. Gravini
(74) *Attorney, Agent, or Firm* — Steinfl & Bruno LLP

(57) ABSTRACT

The present invention discloses an automatic plant and a method of stockage in a covered yard of petcoke fuel with high humidity-contents, natural dehumidification up to set humidity values and subsequent reuptake for conveyance to the silos feeding a thermal unit.

14 Claims, 1 Drawing Sheet

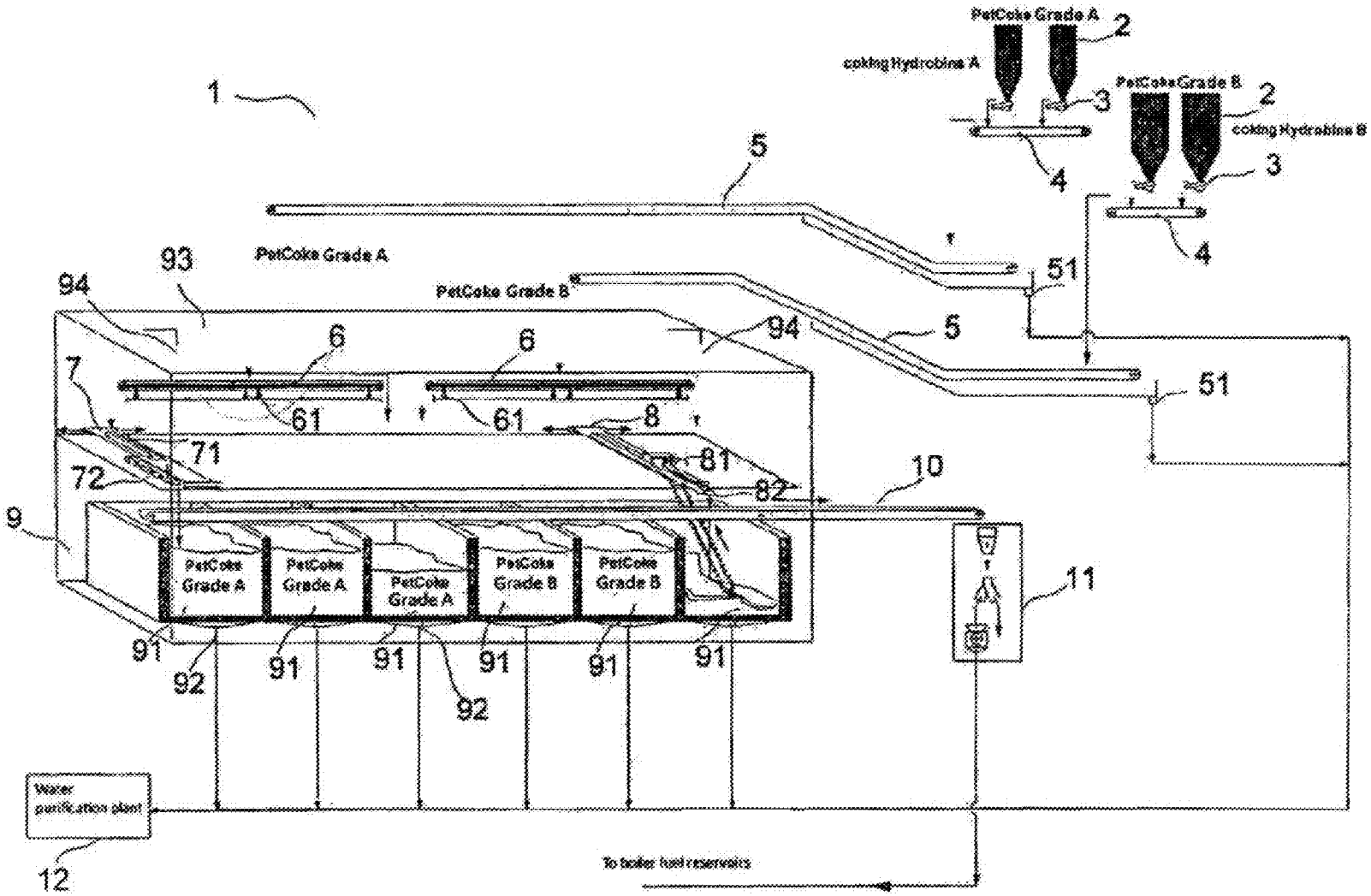
PetCoke Grade A
coking Hydrocarbons A
PetCoke Grade B
coking Hydrocarbons B
PetCoke Grade A
PetCoke Grade B
PetCoke Grade B
PetCoke Grade B
PetCoke Grade A
PetCoke Grade A
PetCoke Grade A
To boiler fuel reservoirs
Water purification plant
1
2
3
4
5
6
7
8
9
10
11
12
51
61
71
72
81
82
91
92
93
94

AUTOMATIC SYSTEM OF STORAGE, DEHUMIDIFICATION AND REUPTAKE OF PETCOKE IN A COVERED YARD

CROSS REFERENCE TO RELATED APPLICATIONS

The present application is the U.S. national stage of International Application PCT/IB2008/001998 filed on Feb. 18, 2008 which, in turn, claims priority to Italian Application MI/2007/A000343, filed on Feb. 22, 2007.

Petcoke, that is coke originating from petrochemical plants, coming out from the codification plants, is traditionally conveyed as a fluidic mixture near the power plant yard, where it is stored in dehydration silos known under the trade mark Hydrobin® in order to reduce the water contents of petcoke under 20%.

From the Hydrobin® silos petcoke is placed in a generally open yard, where with the aid of scrapers and a proper residence time, it loses water naturally up to about 10-12%. After that, petcoke is pushed onto the grids of the loading system to be subsequently conveyed to the feeding silos of the actuated thermal unit.

This traditional open yard system has several inconveniences, such as spreading petcoke in the surrounding environment, dependence of the petcoke uptake from the weather conditions or the inevitable consequence of having to feed the boiler with fuel having a greater moisture contents than expected with consequent lower throughput. Several other problems arise in moving fuel with higher humidity, prone to packings, with the risk of blocking fuel feed to the boiler and/or requiring proper anti-packing devices with often uncertain results. Use of a covered yard however, while removing said inconveniences, causes other problems due to the presence of operators in areas with high dust contents.

The present invention solves all these problems and discloses the equipment and methods used for this purpose.

The present invention comprises an automatic system of storage in a compartmented covered yard, dehumidification and reuptake of petcoke in a continuous and constant way, by adopting the programmed turnover technique to move petcoke at the required humidity.

The main advantages of the invention may be considered as follows

- spreading petcoke dust to the surrounding environment is avoided;
- constant humidity of petcoke reuptaken from the yard;
- process automation;
- elimination of mechanical loaders to move petcoke in the yard.

Moreover it is possible to make separate compartments with independent feeding and reuptake systems, when production of various grades of petoke e.g. with different sulphur contents is required.

To sum up the hereinafter detailed description of the preferred embodiments, the present invention relates to an automatic system comprising the following components:

- A mechanical conveying and yard storing system from the Hydrobin® silos to the covered storage and reuptake yard;
- A covered yard comprising a petcoke storing construction provided with compartments and a floor of cement or other waterproof material, to avoid underground seepage of residues as well as a proper system for collection of water drained from petcoke with inclined bottom;

- An automated petcoke distribution mechanical system in the compartments of the storage and reuptake construction, comprising:
  - conveyor belt;
  - shuttle belt;
  - longitudinally travelling bridge crane on which a fixed belt and shuttle belt are mounted;
- an automated petcoke reuptake mechanical system from the compartments of the storage and reuptake construction, comprising a single machine in the form of a transversally movable and liftable dredging elevator mounted on a longitudinally travelling bridge crane;
- a mechanical conveyance system feeding petcoke from the dredging elevator to the crushing line and then to the loading line for the silos feeding the thermal unit;
- a regulation and control system adapted to ensure the automatic development of said operation as it will be illustrated in the operation description;
- a ventilation system of the storage and reuptake construction, allowing to keep the environment under slight negative pressure to avoid dust leakage to the outside.

Other advantages, features and operative modes of the present invention will be clearly apparent from the following detailed description of some preferred embodiments, given as illustrative and not limiting examples.

Reference will be made to the accompanying drawings, in which:

FIG. 1 shows an illustrative general diagram of a preferred embodiment of the inventive plant, providing for storage of two different grades of petcoke A and B e.g. with a different sulphur contents and three storage departments for each grade.

With reference to the FIGURE of the drawings, the petcoke conveyance, storage and reuptake plant is generally indicated with numeral 1. As it will be appreciated from the following description, plant 1 is particularly adapted to carry out conveyance of petcoke outgoing from the Hydrobin® silos to the stockage and reuptake construction, and allows the automatic positioning in the relevant compartment and the reuptake of the dehumidified petcoke, after a proper stockage time, to be fed to an actuated thermal unit.

As mentioned in the summary part hereof, the inventive automatic plant by using the programmed turnover technique, allows to dispose wet petcoke in a compartment just emptied or containing still wet petcoke and to take out petcoke from the compartment where the set stockage time is over, thus containing petcoke with such a humidity contents that it can be reuptaken.

The final humidity degree (10-12%) of petcoke conveyed to the boiler, depends upon the need to reduce the energy consumption for heating and evaporating water contained in the fuel during the combustion process, but it has a lower limit (about 8%) to avoid phenomena of spontaneous ignition during the conveyance from the yard to the fuel reservoirs for boiler feed.

For a better illustrative purpose, the various components of plant 1 will be hereinafter described making reference to the route followed by petcoke outgoing from the Hydrobin® silos, where petcoke is being separated from the carrier water, up to loading the boiler feeding fuel reservoirs.

Immediately downstream the Hydrobin® or dehydration silos or similar first dehydration devices 2, petcoke is discharged on the rubber belt conveyor 4 or the like through the vibrating channels 3.

Downstream conveyor 4 a second conveyor 5 of the some kind feeds the automatic stockage system inside the covered yard 9.

These conveyors are provided with a cover 93 to avoid spreading of material to the environment and have a first inclined length to make easier return of possible excess water to an underground channel 51 and then to the main water purification plant 12.

The covered yard 9 consists of a compartmented construction 91; in the illustrated embodiment there are three compartments 91*a*, 91*b*, 91*c* for each fuel grade, where the lower case letters refer to three different petcoke dehydration stages in connection with the residence time in the relevant compartments 91, with the bottom 92 of each compartment made of cement and inclined so as to enhance drain of water contained in the petcoke stocked therein, to the main water purification plant 12. Some features improve dehumidification of stocked fuel such as transparent covers 93, the inner ventilation system 94 so as to keep the inner yard environment under a light vacuum, thus avoiding any possibility of dust going out or spreading to the outside. The collected condensate must be conveyed to the main water purification plant 12 to remove any moisture and dust.

Hereinafter as an illustrative non limiting example, A and B refer to two different sulphur contents, therefore two grades of coke that may also be contained at the same time in the plant with sets of compartments 91.

The automated petcoke distribution systems allows stockage in the relevant compartments 91*a*, 91*b*, 91*c* of wet petcoke. This automated distribution system comprises a rubber belt conveyor 6 supported on wheels 61 adapted to move longitudinally so as to reach all the compartments 91*a*, 91*b*, 91*c* available in the covered yard 9.

Conveyor 6 in turn feeds a rubber belt conveyor 71 discharging onto a second rubber belt shuttle conveyor 72 both connected to the bridge crane 7. The combination of the longitudinal movement of bridge crane 7 and the transversal movement of the shuttle belt 72 allows to distribute petcoke in the available compartments in a uniform way inside each compartment.

Compartments 91*a*, 91*b*, 91*c* have a capacity equal to the daily petcoke output coming from each coking tower (not shown) for each production grade. Therefore the automatic system of distribution and reuptake of petcoke in a covered yard, provides for filling the compartments with the programmed turnover rule. For instance, starting from a steady state situation, when petcoke is discharged into the first compartment (e.g. 91*a*), the reuptake system will operate on the third compartment (e.g. 91*c*), thus ensuring that reuptaken coke stayed for a two days stockage time, that as an average warrants a final humidity contents of about 10-12%. Each compartment 91*a*, 91*b*, 91*c* has an inclined bottom so as to convey drained water to its bottom 92 and from said bottom to the water purification plant 12.

The automated reuptake system comprises a single machine in the form of a dredging elevator 81 or the like, feeding petcoke taken from compartment 91 to a fixed rubber belt conveyor 82 or the like. Both machines are mounted on the bridge crane 8, and the dredging recovery machine 81 is also provided with wheels for the transversal movement. Once recovered, petcoke is fed to a conveyor 10 having a wheel base covering the entire yard length. By means of conveyor 10 petcoke is conveyed to the crushing system 11 and then to the fuel reservoirs of the boiler. These crushing and conveyance means are not illustrated as they belong to the state of the art and therefore are not a part of the present invention.

The dedicated regulation and control system for the inventive automated system is adapted to ensure the automatic development the above described operations.

Said predetermined values of final petcoke humidity and stockage time may be selectively set by an operator managing plant 1.

The present invention has been described with reference to preferred embodiment. It is to be understood that other embodiments involving the same inventive core may occur to a man skilled in the art, without departing however from the protection scope of the appended claims.

The invention claimed is:

1. An automatic system of stockage in a covered yard of petcoke fuel with high moisture contents, natural dehumidification up to predetermined humidity values and subsequent reuptake, said automatic system comprising:

mechanical conveyors of petcoke with high humidity contents coming from first dehydration plants;

a covered yard comprising a construction provided with compartments with a bottom adapted to receive said petcoke with high humidity contents, wherein natural dehumidification of petcoke up to set humidity values occurrs inside said compartments;

an automated mechanical plant for distribution of high humidity petcoke in said compartments;

an automated mechanical plant for petcoke reuptake from said compartments with set humidity contents;

a ventilation system inside the covered yard promoting dehumidification of stocked material and keeping yard environment under a light vacuum to avoid dust spreading; and a regulation and control system allowing automatic operation of the automatic system.

2. The automatic system of claim 1, wherein the mechanical conveyors are provided with covers to avoid spreading of material to the surrounding environment.

3. The automatic system of claim 1, further comprising a channel under a mechanical conveyor of said mechanical conveyors, the channel being connected to a water purification plant, to recover excess water in the conveyed material.

4. The automatic system of claim 1, wherein the regulation and control system allows distribution of daily petcoke production to a predetermined compartment and reuptake of the daily petcoke production after a stockage time set by an operator, said time depending upon a desired final humidity degree.

5. The automatic system of claim 1, wherein the covered yard comprises a construction with compartments, each compartment having a capacity adapted to contain a daily petcoke production.

6. The automatic system of claim 1, wherein a cover of the covered yard is made of transparent material to promote natural dehumidification of petcoke stocked therein.

7. The automatic system of claim 1, wherein the bottom of each compartment is made of waterproof material.

8. The automatic system of claim 1, wherein the bottom of each compartment of the covered yard has an inclination to allow natural outflow drained during petcoke stockage to a main water purification plant.

9. The automatic system of claim 1, wherein the ventilation system generates a slight vacuum inside the covered yard to avoid spreading of dust to the outside.

10. The automatic system of claim 1, wherein the conveyor is provided with wheels allowing longitudinal movement of the conveyor to obtain petcoke distribution to all the compartments of the covered yard.

11. The automatic system of claim 1, wherein automated mechanical plant for distribution of high humidity petcoke is capable of longitudinal and transversal movement, and comprises a bridge crane on which a fixed belt conveyor and a shuttle conveyor are mounted.

12. The automatic system of claim 1, wherein the automated mechanical plant for petcoke reuptake from said compartments of the covered yard is capable of longitudinal and transversal movements, and comprises a bridge crane on which a dredging elevator or equivalent machine acting as a shuttle and a fixed conveyor are mounted, said conveyor feeding a fixed conveyor comprising a wheel base to operate the reuptake from all the compartments of the covered yard.

13. A method of distribution, dehumidification and reuptake of petcoke from a covered yard comprising:

automatically loading high humidity petcoke outgoing from first dehydration plants;

automatically feeding high humidity petcoke to the covered yard;

automatically distributing high humidity petcoke to an empty compartment of the covered yard; and automatically reuptaking of petcoke from the compartment where the petcoke stayed for a stockage residence time equal to a value set by an operator.

14. The method of claim 13, wherein said feeding and reuptaking are regulated according to a programmed turnover, depending on a delay time set by the operator, said delay being equal to a stockage time needed for the petcoke to reach a final humidity degree.

* * * * *